US007487782B2

(12) United States Patent
Sasaki et al.

(10) Patent No.: US 7,487,782 B2
(45) Date of Patent: Feb. 10, 2009

(54) CIGARETTE FILTER

(75) Inventors: Takashi Sasaki, Tokyo (JP); Masafumi Tarora, Tokyo (JP); Takashi Hasegawa, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 424 days.

(21) Appl. No.: 11/081,549

(22) Filed: Mar. 17, 2005

(65) Prior Publication Data

US 2005/0161054 A1 Jul. 28, 2005

Related U.S. Application Data

(63) Continuation of application No. PCT/JP03/11725, filed on Sep. 12, 2003.

(30) Foreign Application Priority Data

Sep. 19, 2002 (JP) ..... 2002-273288

(51) Int. Cl.
*A24D 3/16* (2006.01)

(52) U.S. Cl. ..... 131/334; 131/331

(58) Field of Classification Search ..... None
See application file for complete search history.

(56) References Cited

U.S. PATENT DOCUMENTS

| | | | |
|---|---|---|---|
| 2,968,306 | A | 1/1961 | Touey et al. |
| 3,370,592 | A | 2/1968 | Schultz et al. |
| 3,605,759 | A | 9/1971 | Owens et al. |
| 3,635,226 | A | 1/1972 | Horsewell et al. |
| 3,802,441 | A | 4/1974 | Hannersmith |
| 4,763,674 | A | 8/1988 | Lelah |
| 5,690,127 | A | 11/1997 | Chapman et al. |
| 5,860,428 | A | 1/1999 | Lesser |
| 6,311,695 | B1 | 11/2001 | Williams |
| 6,311,696 | B1 | 11/2001 | Dittrich et al. |

FOREIGN PATENT DOCUMENTS

| | | | |
|---|---|---|---|
| CA | 2239494 | | 6/1997 |
| GB | 908185 | A | 10/1962 |
| GB | 1078340 | A | 8/1967 |
| GB | 1255564 | A | 12/1971 |
| GB | 1255657 | A | 12/1971 |
| GB | 1502680 | A | 3/1978 |
| JP | 62-272963 | A | 11/1987 |
| RU | 2156099 | | 9/2000 |
| SU | 738495 | | 5/1980 |
| WO | WO-96/28133 | A | 9/1996 |
| WO | WO-02/21948 | A1 | 3/2002 |

OTHER PUBLICATIONS

Taiwan Patent Office, Decision of Rejection, Apr. 20, 2004, Taiwan.
Derwent Publications Ltd., London, GB; AN 1979-09448B And SU 597 510 A-03-14-1978.

*Primary Examiner*—Philip C Tucker
*Assistant Examiner*—Michael J Felton
(74) *Attorney, Agent, or Firm*—Birch, Stewart, Kolasch & Birch, LLP

(57) ABSTRACT

A cigarette filter has a filter medium containing an inorganic basic substance such as sodium carbonate and a moisturizing agent selected from the group consisting of glycerin, sodium propionate and sodium lactate.

1 Claim, 4 Drawing Sheets

CIGARETTE FILTER

CROSS REFERENCE TO RELATED APPLICATIONS

This is a Continuation Application of PCT Application No. PCT/JP03/11725, filed Sep. 12, 2003, which was published under PCT Article 21(2) in Japanese.

This application is based upon and claims the benefit of priority from prior Japanese Patent Application No. 2002-273288, filed Sep. 19, 2002, the entire contents of which are incorporated herein by reference.

BACKGROUND OF THE INVENTION

1. Field of the Invention

The present invention relates to a cigarette filter capable of lowering the amount of aldehydes contained in the mainstream smoke of a cigarette.

2. Description of the Related Art

Various chemical components are contained in the mainstream smoke puffed by a smoker in smoking a cigarette. It is difficult to adsorb and remove aldehydes represented by formaldehyde among these chemical components with an ordinary cigarette filter. Therefore, it is desired to remove the aldehydes from the mainstream smoke of the cigarette.

It is attempted in the past to use various additives in the cigarette filter in order to adsorb and remove the aldehydes contained in the mainstream smoke of the cigarette. However, the use of the conventional additives gives rise to a problem of impairing tobacco taste.

BRIEF SUMMARY OF THE INVENTION

An object of the present invention is to provide a cigarette filter, which permits effectively lowering the amount of aldehydes in the mainstream smoke of a cigarette while suppressing the detrimental effects such as degradation of tobacco taste.

A cigarette filter according to an aspect of the present invention is characterized by comprising a filter medium containing an inorganic basic substance selected from the group consisting of a carbonate and a phosphate and a moisturizing agent.

The carbonate used in the present invention is selected from the group consisting of sodium carbonate, potassium carbonate, sodium bicarbonate, potassium bicarbonate and ammonium bicarbonate. The phosphate used in the present invention is selected from the group consisting of sodium phosphate, potassium phosphate, disodium hydrogenphosphate, dipotassium hydrogenphosphate, sodium dihydrogenphosphate, potassium dihydrogenphosphate, and ammonium dihydrogenphosphate. The moisturizing agent used in the present invention is selected from the group consisting of glycerin, sodium propionate, and sodium lactate.

In the cigarette filter of the present invention, it is desirable for the inorganic basic substance to be contained in an amount of 3.5 mg or more.

In the cigarette filter of the present invention, it is desirable for the ratio of the inorganic basic substance to the moisturizing agent to fall within a range of between 1:1 and 1:2.

DETAILED DESCRIPTION OF THE INVENTION

Figure 1:
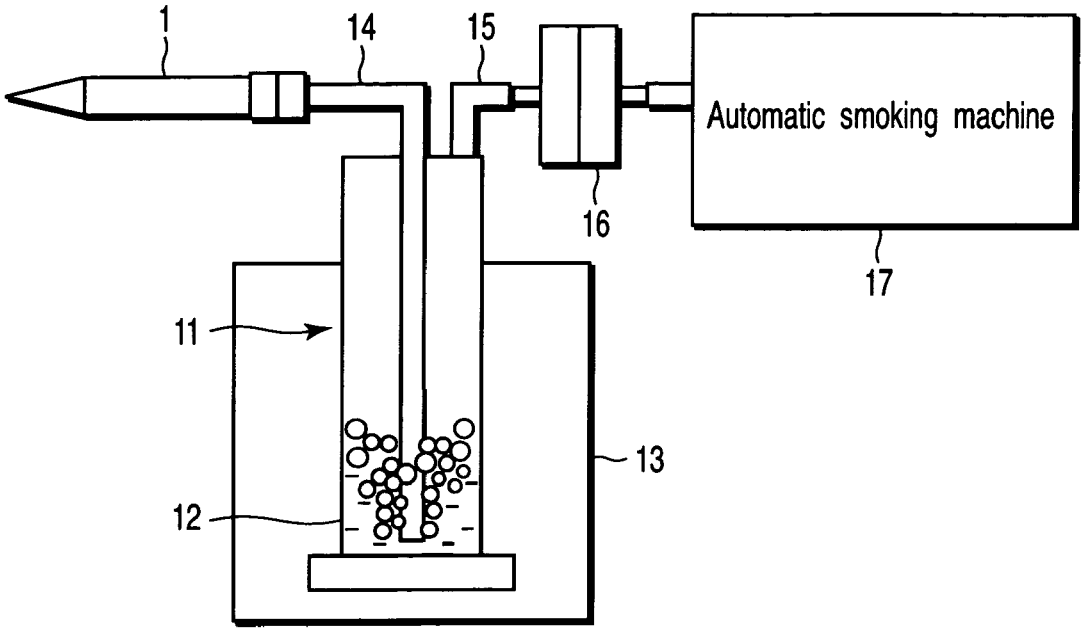
FIG. 1 schematically shows the construction of an apparatus for measuring formaldehyde contained in the mainstream smoke of a cigarette in the Examples of the present invention.

As a result of extensive research conducted from various viewpoints on additives in an attempt to lower aldehydes contained in the mainstream smoke of a cigarette, the present inventors have found that an inorganic basic substance selected from the group consisting of a carbonate and a phosphate is an effective additive. The carbonate used in the present invention is selected from the group consisting of, for example, sodium carbonate, potassium carbonate, sodium bicarbonate, potassium bicarbonate and ammonium bicarbonate. The phosphate used in the present invention is selected from the group consisting of sodium phosphate, potassium phosphate, disodium hydrogenphosphate, dipotassium hydrogenphosphate, sodium dihydrogenphosphate, potassium dihydrogenphosphate, and ammonium dihydrogen phosphate.

The present inventors have also found that the aldehydes contained in the mainstream smoke of a cigarette can be more effectively removed if the inorganic basic substance is used in combination with a moisturizing agent. The moisturizing agent used in the present invention is selected from the group consisting of glycerin, sodium propionate and sodium lactate.

It is possible to use an ordinary filter medium such as acetate tow, a paper filter material, or a pulp unwoven fabric as the carrier (filter raw material) for the inorganic basic substance and the moisturizing agent.

It is believed that, in the cigarette filter of the present invention, the aldehydes in the mainstream smoke of a cigarette are lowered by the mechanism given below. In the first step, the aldehydes contained in the mainstream smoke of a cigarette are dissolved in water held by the moisturizing agent carried by the filter. Further, the aldehydes dissolved in the water are allowed to react with the inorganic basic substance carried by the filter so as to be trapped within the filter. It should be noted that the moisturizing agent functions to stably hold the water serving to dissolve the aldehydes.

In the cigarette filter of the present invention, the inorganic basic substance should be contained in an amount of 3.5 mg or more, because it is difficult to obtain a sufficient effect of lowering the aldehydes where its amount is smaller than 3.5 mg.

Also, in the cigarette filter of the present invention, the ratio of the inorganic basic substance to the moisturizing agent is specified to fall within a range of between 1:1 and 1:2. If the ratio noted above fails to fall within the range noted above, it is difficult to obtain a sufficient effect of lowering the aldehydes.

For allowing the filter medium to contain the inorganic basic substance and the moisturizing agent, it is possible to employ such a method as spraying, dipping and roller transfer.

It is also possible to allow the filter medium to contain activated charcoal in addition to the inorganic basic substance and the moisturizing agent.

The configuration of the filter tip may be a plain type, a dual type, a multi-segment type having triple or more segments, or a plug-space-plug type. It is possible for the inorganic basic substance and the moisturizing agent to be contained in a part or all the segments of the filter tip.

The cigarette filter of the present invention may be a filter connected to the tobacco section of a cigarette as a mouth end component or a filter in the form of a cigarette holder.

EXAMPLES

In the method of measuring the aldehydes contained in the mainstream smoke of a cigarette, which is used in the following Examples, the derivative of 2,4-dinitrophenyl hydrazine (DNPH), a trapping substance, is measured by high-speed liquid chromatography (HPLC). The substances that can be measured simultaneously by this method are eight components consisting of formaldehyde, acetaldehyde, acetone, acrolein, propionaldehyde, crotonaldehyde, methyl ethyl ketone and n-butylaldehyde. In the following Examples, the description is directed to formaldehyde among the aldehydes (carbonyl compounds) that are to be measured.

In the first step, a trapping solution is prepared by dissolving 9.51 g of 2,4-dinitrophenyl hydrazine (DNPH) in 1L of acetonitrile, followed by adding 5.6 mL of 60% perchloric acid and subsequently diluting the resultant solution with ultra pure water to 2L.

The construction of the measuring apparatus will now be described with reference to FIG. 1. As shown in FIG. 1, a DNPH trapping solution 12 is put in a Drechsel type trap 11. The Drechsel type trap 11 has an inner volume of 250 mL, the amount of the DNPH trapping solution is 100 mL, and the dead volume is 150 mL. The Drechsel type trap 11 is put in an ice water bath 13 so as to be cooled. The lower end of a glass pipe 14 having a cigarette 1 mounted to the top end thereof is dipped in the trapping solution 12 within the Drechsel type trap 11. Further, a glass pipe 15 and a Cambridge pad 16 are mounted to communicate with the dead volume of the Drechsel type trap 11, and an automatic smoking machine 17 is connected to the Cambridge pad 16.

The cigarette 1 is attached to the glass pipe 14 so as to permit the cigarette 1 to be automatically smoked under the standard smoking conditions specified in ISO standards. To be more specific, the operation of sucking 35 mL of the smoke in a single puff for two seconds is repeated at an interval of 58 seconds for a single cigarette. While the mainstream smoke is being bubbled, eight components of carbonyl compounds are converted into derivatives of DNPH. Two cigarettes are used for the measurement.

The derivatives thus formed are measured by HPLC. In the first step, the trapping solution is filtered, followed by diluting the filtrated trapping solution with a Trizma Base solution (4 mL of trapping solution: 6 mL of Trizma Base solution). Then, the diluted solution is measured by HPLC. The measuring conditions for HPLC are as follows:

Column: HP LiChrospher 100RP-18(5μ)250×4 mm;

Guard column: HP LiChrospher 100RP-18(5μ)4×4 mm;

Column temperature: 30° C.;

Detection wavelength: DAD 356 nm;

Injection amount: 20 μL;

Mobile phase: Gradients with three phases (solution A: ultra pure aqueous solution containing 30% of acetonitrile, 10% of tetrahydrofuran and 1% of IPA; solution B: ultra pure aqueous solution containing 65% of acetonitrile, 1% of tetrahydrofuran and 1% of IPA; and solution C: 100% of acetonitrile).

Figure 2:
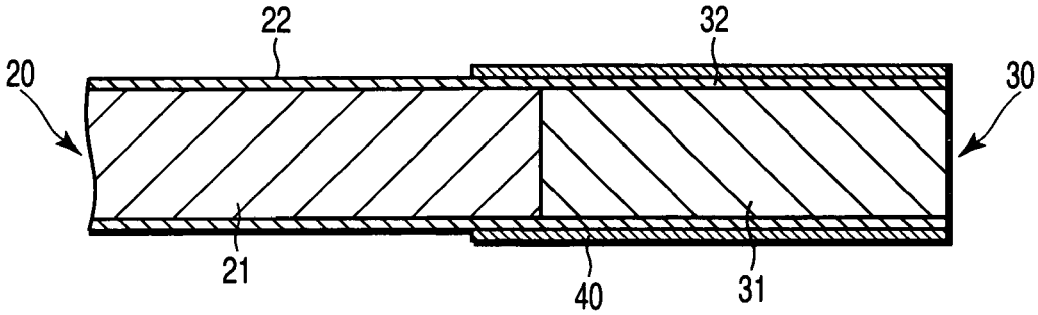
FIG. 2 is a cross-sectional view showing the construction of a cigarette used in the Examples of the present invention.

The construction of the cigarette used as a sample will now be described with reference to the cross-sectional view shown in FIG. 2. As shown in FIG. 2, the cigarette has a tobacco section 20 in which cut tobacco 21 is wrapped with a cigarette wrapper 22, and a filter section 30 in which a filter 31 is wrapped with a forming paper 32. The filter section 30 is connected to the tobacco section 20 by using a tipping paper 40. It is possible to use, for example, cellulose acetate tow as the filter material.

In testing a cigarette prepared by using a test filter having an inorganic basic substance and a moisturizing agent added thereto, a tobacco section is taken out by cutting the acetate filter from a 6 mg-tar cigarette available on the market, and the tobacco section is connected to the test filter so as to provide a sample. An atomizer is used for adding an inorganic basic substance and a moisturizing agent to the test filter.

Test 1:

A 25 mm-long acetate filter was prepared as a base filter. Test filters were prepared by allowing the base filter to contain 3.5 mg of an additive. The additive, i.e., an inorganic basic substance, was selected from the group consisting of potassium bicarbonate ($KHCO_3$), sodium bicarbonate ($NaHCO_3$), potassium carbonate ($K_2CO_3$), sodium carbonate ($Na_2CO_3$), ammonium bicarbonate ($NH_4HCO_3$), sodium dihydrogenphosphate ($NaH_2PO_4$), ammonium dihydrogenphosphate ($NH_4H_2PO_4$), disodium hydrogenphosphate ($Na_2HPO_4$), dipotassium hydrogenphosphate ($K_2HPO_4$), potassium phosphate ($K_3PO_4$), and sodium phosphate ($Na_3PO_4$).

Figure 3:
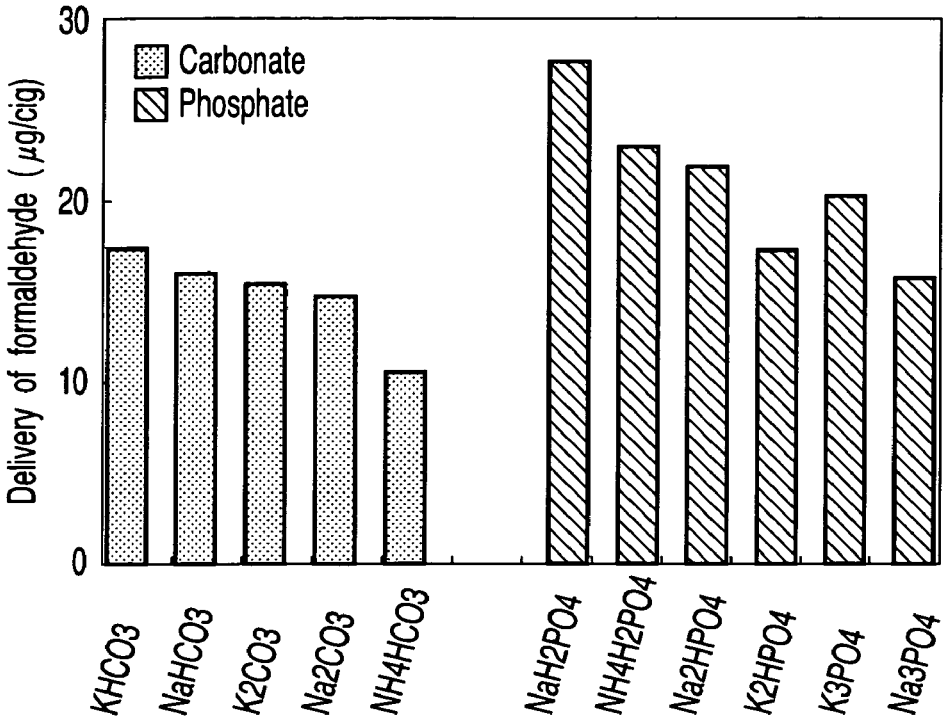
FIG. 3 is a graph showing the delivery of formaldehyde depending on the type of an inorganic basic substance added to a cigarette filter.

Each filter was connected to the tobacco section noted above to prepare a sample cigarette, and the delivery of formaldehyde (μg/cig) in the mainstream smoke per cigarette was measured by the measuring method described above. FIG. 3 is a graph showing the results. FIG. 3 clearly supports that the delivery of formaldehyde from the filter containing any of the inorganic basic compounds shown in FIG. 3 is smaller than that from the base filter. Particularly, sodium carbonate, potassium carbonate and ammonium bicarbonate have been found to be effective.

Incidentally, it has been found that, in order to lower the delivery of formaldehyde, the amount of an inorganic basic compound in the filter should preferably be 3.5 mg or more.

Figure 4:
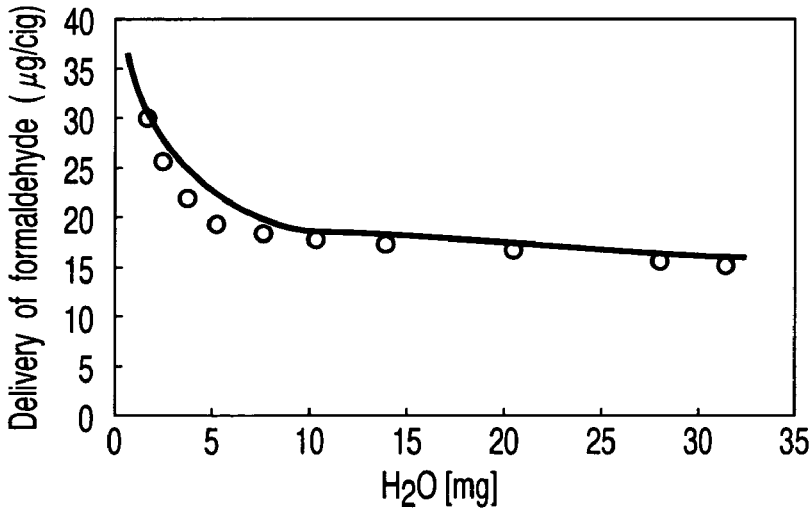
FIG. 4 is a graph showing the relationship between the amount of water added to a cigarette filter together with sodium carbonate and the delivery of formaldehyde.

Test 2:

The base filter was allowed to contain 3.5 mg of sodium carbonate and a varied amount of water. Each of the filters differing in the water content was connected to the tobacco section noted above to prepare a sample cigarette, and the delivery of formaldehyde (μg/cig) in the mainstream smoke per cigarette was measured by the measuring method described above. FIG. 4 is a graph showing the results. As apparent from FIG. 4, formaldehyde in the mainstream smoke can be effectively lowered if the water content of the filter is 5 mg or more in the case where the filter contains 3.5 mg of sodium carbonate.

Figure 5:
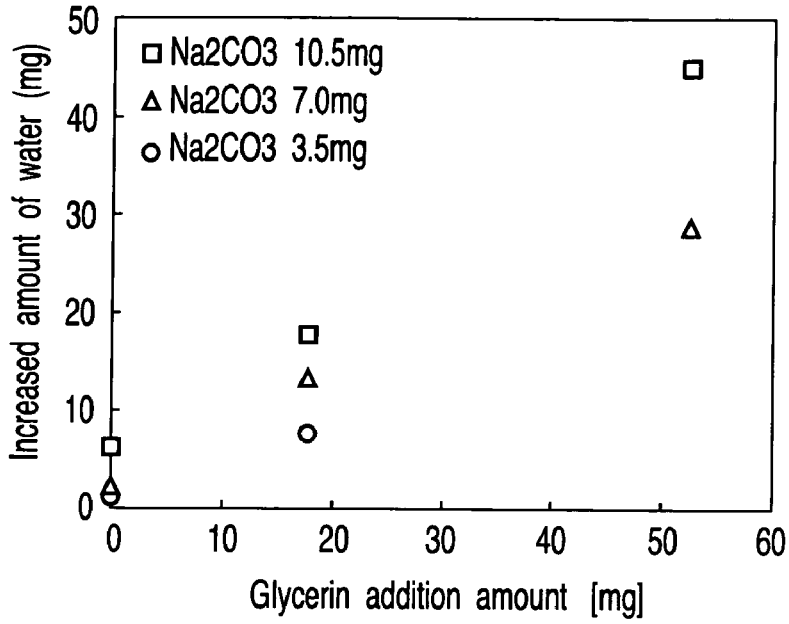
FIG. 5 is a graph showing the relationship between the amount of glycerin added to a cigarette filter together with sodium carbonate and the increased amount of water in the cigarette filter.

Test 3:

The base filter was allowed to contain sodium carbonate and glycerin used as a moisturizing agent so as to examine the increased amount of water in the filter. The sodium carbonate content was set at 3.5 mg, 7.0 mg or 10.5 mg. The glycerin content was set at 18 mg or 52 mg. FIG. 5 is a graph showing the results. FIG. 5 clearly supports that the amount of water held by the filter can be increased with increase in the amount of the moisturizing agent, i.e., glycerin.

Figure 6:
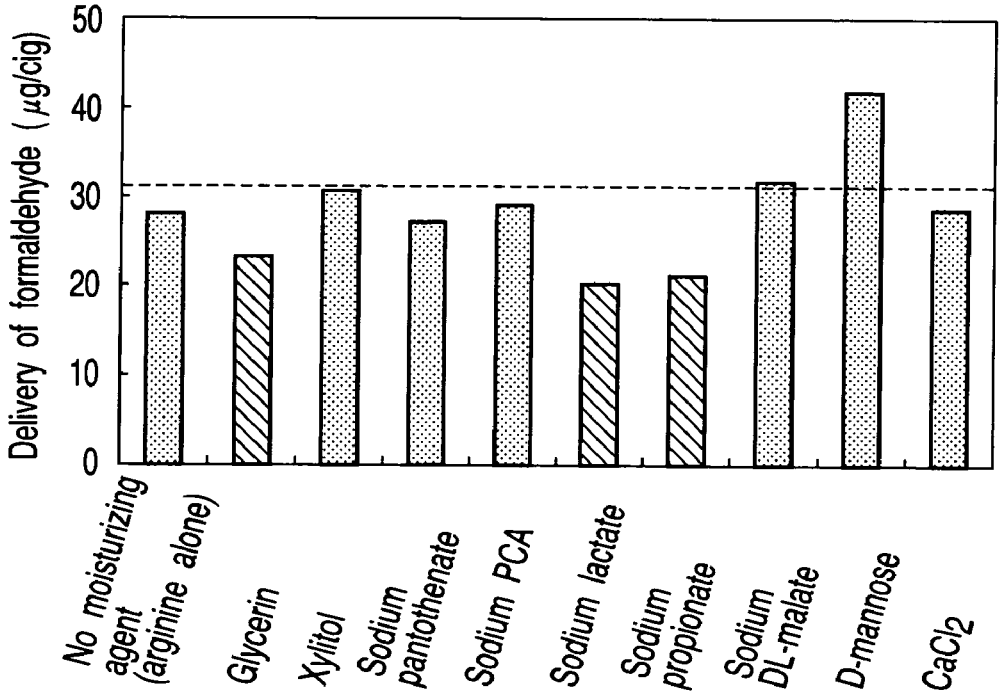
FIG. 6 is a graph showing the delivery of formaldehyde depending on the type of a moisturizing agent added to a cigarette filter together with sodium carbonate.

Test 4:

A test filter for reference, containing no moisturizing agent, was prepared by allowing the base filter to contain 3.5 mg of sodium carbonate alone. Also, test filters were prepared by allowing the base filters to contain 3.5 mg of sodium carbonate and a moisturizing agent. The moisturizing agent used was selected from the group consisting of glycerin, xylitol, sodium pantothenate, sodium PCA, sodium lactate, sodium propionate, sodium DL-malate, D-mannose and calcium chloride. Each test filter was connected to the tobacco section noted above to prepare a sample cigarette, and the delivery of formaldehyde (μg/cig) in the mainstream smoke per cigarette was measured by the measuring method described above. FIG. 6 is a graph showing the results. As apparent from FIG. 6, glycerin, sodium lactate and sodium propionate, which are used as the moisturizing agents, permit effectively lowering the delivery of formaldehyde, compared with the case where the base filter was allowed to contain sodium carbonate alone. These moisturizing agents are also suitable in view of the manufacturing process of the filter.

Test 5:

Various test filters in which the base filter contained 3.5 mg of sodium carbonate and a varied amount of sodium lactate used as the moisturizing agent were prepared. The ratio of sodium lactate to L-arginine was set at 1:1, 1:2 or 1:3.

Figure 7:
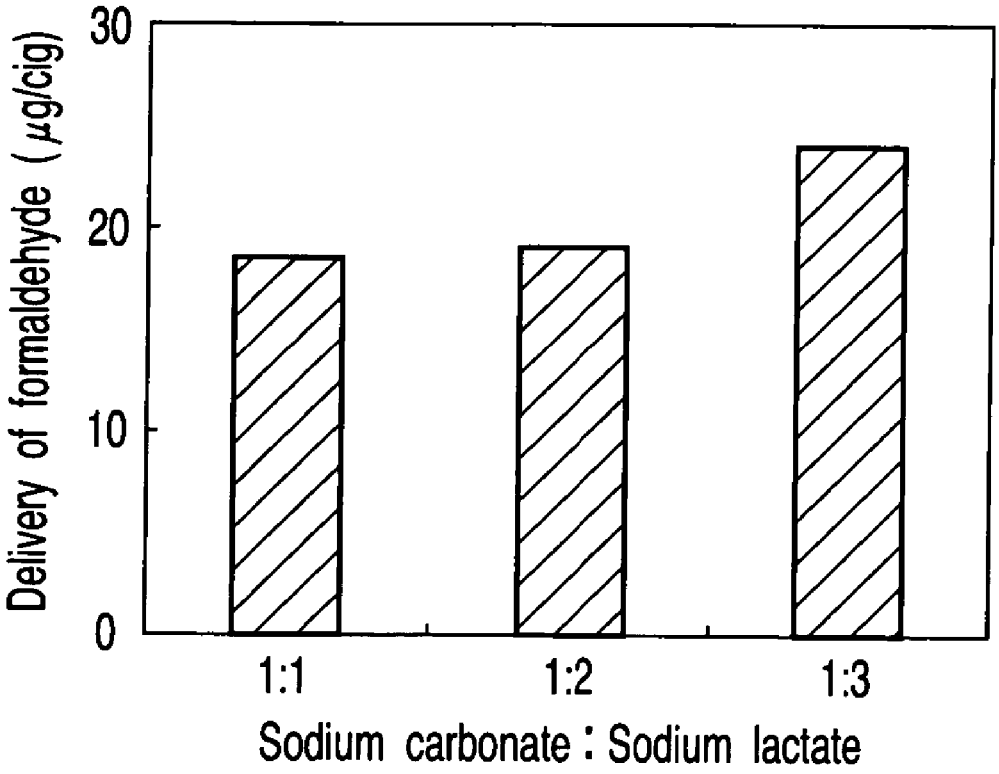
FIG. 7 is a graph showing the relationship between the ratio of sodium carbonate to glycerin added to a cigarette filter and the delivery of formaldehyde.

Each test filter was connected to the tobacco section noted above to prepare a sample cigarette, and the delivery of formaldehyde (μg/cig) in the mainstream smoke per cigarette was measured by the measuring method described above. FIG. 7 is a graph showing the results. FIG. 7 supports that the delivery of formaldehyde in the mainstream smoke can be effectively lowered by allowing the base filter to contain sodium carbonate and sodium lactate at a ratio of 1:1 or 1:2.

The cigarette filter of the present invention makes it possible lower effectively the amount of aldehydes contained in the mainstream smoke of a cigarette.

What is claimed is:

1. A cigarette filter, comprising a filter medium containing an inorganic basic substance selected from the group consisting of sodium carbonate, potassium carbonate, sodium bicarbonate, potassium bicarbonate and ammonium bicarbonate, sodium phosphate, potassium phosphate, disodium hydrogenphosphate, dipotassium hydrogenphosphate, sodium dihydrogenphosphate, potassium dihydrogenphosphate, and ammonium dihydrogenphosphate, and a moisturizing agent consisting of sodium propionate, wherein the inorganic basic substance is contained in an amount of 3.5 mg and 10.5 mg, and wherein a ratio of the inorganic basic substance to the moisturizing agent falls within a range of between 1:1 and 1:2.

* * * * *